US007475582B2

(12) United States Patent
Vanleene

(10) Patent No.: US 7,475,582 B2
(45) Date of Patent: Jan. 13, 2009

(54) CHANGEOVER SYSTEM AND CHANGEOVER METHOD FOR A METAL FORMING MILL

(75) Inventor: Paul Vanleene, Voortkapel-Westerlo (BE)

(73) Assignee: Scambia Industrial Development AG, Schaan (LI)

( * ) Notice: Subject to any disclaimer, the term of this patent is extended or adjusted under 35 U.S.C. 154(b) by 16 days.

(21) Appl. No.: 10/591,102

(22) PCT Filed: Jan. 6, 2005

(86) PCT No.: PCT/CH2005/000005

§ 371 (c)(1),
(2), (4) Date: Aug. 30, 2006

(87) PCT Pub. No.: WO2005/082554

PCT Pub. Date: Sep. 9, 2005

(65) Prior Publication Data

US 2007/0186610 A1 Aug. 16, 2007

(30) Foreign Application Priority Data

Mar. 1, 2004 (EP) ..... 04405120

(51) Int. Cl.
*B21B 39/00* (2006.01)

(52) U.S. Cl. ..... 72/226; 72/239

(58) Field of Classification Search ..... 72/238, 72/239, 226, 234, 446, 447, 227, 228, 237
See application file for complete search history.

(56) References Cited

U.S. PATENT DOCUMENTS

| | | | | |
|---|---|---|---|---|
| 3,583,195 | A * | 6/1971 | Sherwood | 72/239 |
| 3,796,081 | A * | 3/1974 | Boardman | 72/181 |
| 4,724,695 | A * | 2/1988 | Stoehr | 72/181 |
| 5,600,988 | A | 2/1997 | Abbey, III et al. | |
| 5,720,195 | A | 2/1998 | Ruple | |
| 5,887,472 | A * | 3/1999 | Abbey, III | 72/238 |

FOREIGN PATENT DOCUMENTS

| | | |
|---|---|---|
| GB | 3792 | 3/1915 |

* cited by examiner

*Primary Examiner*—Dana Ross
*Assistant Examiner*—Debra M Wolfe
(74) *Attorney, Agent, or Firm*—Welsh & Katz, Ltd.

(57) ABSTRACT

A changeover system for a metal forming mill, in particular for a tube-forming mill, comprises at least one pair of work modules, the work modules of which are adapted to be pivoted into and out of a line of work stations of the mill. Each work module has its own drive or drives. Within a pair of work modules the two work modules are arranged such, that when one work module is arranged in the line of work stations the other one is arranged off the line.

13 Claims, 1 Drawing Sheet

CHANGEOVER SYSTEM AND CHANGEOVER METHOD FOR A METAL FORMING MILL

BACKGROUND

During manufacture of many metal products, for example during manufacture of profiled metal parts or tubes, the metal is to be formed to receive the desired shape. In particular in tube mills for producing seam-welded tubes, a continuous metal strip is advanced through several work stations forming a line of work stations. In these work stations, the strip is formed to exhibit a tubular shape having an open, longitudinally extending seam formed by the abutting edges of the strip being formed. The seam is then welded and in case unwanted bead is formed a scarfing procedure may be applied for removing the bead. Obviously, during production of tubes other than seam-welded tubes, the steps of welding and subsequent scarfing can be omitted.

Tubes of various diameters and/or of different cross-sections are to be produced in the same mill, since a mill of this type comprises a number of massive precision machines representing considerable technical and financial expense. In order to be able to manufacture tubes having different diameters and/or different cross sections, different tooling is required in the line of work stations. On the other hand, since the same mill is to be used, an exchange of or a modification to the tooling of at least one work station is required to allow changeover of production from one type of tube to another type. Sometimes exchange of or modifications to the tooling of even more than one work station is required.

In the past, in order to perform the above-mentioned exchange or modification one of the ways was to shut down the production line and to remove and replace the respective tooling or to modify the mounted tooling where possible. Thereafter, the new or modified tooling had to be properly set and adjusted on the line before production could resume. The entire changeover routine could consume a considerable period of time, as much as some hours, thus resulting in a considerable expenditure in time and money. As a result, it has become necessary to maintain unduly large inventories of finished products, contrary to the current trend toward maintaining minimum inventory and frequently changing from the production of one product to another.

An alternative way was to mount the tooling for the next product to be produced "off the line", so that production continued until the tooling for the next product was mounted and was ready for exchange. U.S. Pat. No. 5,887,472 shows an embodiment illustrating this way of changeover from production of a first product to production of a second product of different diameter or shape. In the embodiment described there, the drives of the various work stations along the line always remain in place. At the time the changeover is to be performed the production line is stopped, removable cassettes carrying the tooling are disconnected from their drives, the cassettes are removed (guided by rails in the floor) and the replacement cassettes carrying the tooling required for production of the new product are moved into their place in the production line. The new cassettes are then connected to the drives and production of the new product may start.

While this way of performing the changeover represents substantial progress with regard to efficiency, it still has some disadvantages.

Both mechanical as well as electrical disconnection and reconnection of the cassettes is comparatively complex and time consuming. In the embodiment described in the above-mentioned U.S. Pat. No. 5,887,472 the cassettes are removed with the aid of rails provided in the floor and wheels provided on the support of the cassettes, the said wheels engaging the rails thus enabling movement of the cassettes through the machine hall transverse to and along the production line. A rail system allowing such movements is very space-consuming and also the movement of the cassettes through the machine hall from and to the production line is time-consuming. In addition, movement of the cassettes from and to the production line usually occurs on the production operator's side thus disturbing continuation of the production process during preparation of a changeover.

Although not disclosed in U.S. Pat. No. 5,887,472 overhead (travelling) cranes have been used instead of rails/wheels for removing the cassettes to be replaced from the production line and for moving the new cassettes to be connected to the production line in place. Generally, an overhead crane also represents considerable expense and is often used for different purposes in the machine hall or factory, so that it may not be available at the time it is needed for the changeover of the cassettes. Sometimes, an overhead crane is not available at all. More importantly, however, an overhead crane only allows one cassette at a time to be carried from or to the production line, so that the cassettes can only be exchanged one after another. Accordingly, replacement of the cassettes using an overhead crane is rather time-consuming.

Taking these disadvantages into account, it is an object of the instant invention to suggest an improved changeover system.

SUMMARY

In particular, the inventive changeover system for a metal forming mill, in particular for a tube forming mill, according to the instant invention comprises at least one pair of work modules, which are adapted to be pivoted into and out of a line of work stations of the mill. Each work module has its own drive or drives for driving the elements of the respective work module. Within a pair of work modules the two work modules are arranged such, that when one work module is arranged in the line of work stations the other one is arranged off the line.

Pivoting of a work module (carrying among others some tooling) into and out of the line of work stations is a very simple, quick, reliable and precise manner for performing a changeover, especially when compared to the heretofore existing solutions. The pivoting of a work module into and out of the line of work stations can be performed with or without a drive. It does not require any large space-consuming rail system nor does it require an overhead crane for performing the changeover, thus saving considerable expense and time. Since each work module is provided with its own drive or drives, no electrical and mechanical disconnection and reconnection from and to the drives of the line of work stations (production line) is necessary. Rather, the connections within a module can be maintained when a work module is pivoted out of and into the line of work modules. Also, space consumption is minimal. Once a module has been pivoted out of the line of work stations (production line), the tooling of that module can be either replaced in preparation for production of a new product or the tooling can be left as it is thus being prepared to produce the product that has been produced prior to the changeover. Also, the pivoting into and out of the line of work stations can be performed such that the production operator is not disturbed. In contrast to known changeover systems, the replacement or maintenance of all elements (drives, gear boxes, couplings, tooling) of an "off-line" module can be performed without disturbing the running production process. Also, the wear of the drive elements is reduced, since on average the drive elements are used only 50% of the time production is running (since one module is always off the line).

In an embodiment of the changeover system according to the instant invention, the work modules of the pair or pairs of work modules are provided with wheels for engaging the floor in order to simplify the pivotal movement of the work modules into and out of the line of work stations.

In a further embodiment of the changeover system according to the instant invention, the system comprises rails arranged on the floor in the area where the pair or pairs of work modules are arranged. The wheels of the work modules engage the rails, thus enabling a guided pivotal movement of the work modules into and out of the line of work stations. Since the rails are arranged only in the area where the pair or pairs of work modules are arranged, the overall expense and space consumption is low. On the other hand, this solution simplifies the pivotal movement.

While the invention is not limited to tube forming mills, it is particular suitable for such mills. Accordingly, in one embodiment of the changeover system according to the invention, the work modules comprise rollers for forming a tube or an open profile. Accordingly, a metal forming mill and in particular a tube forming mill comprising a line of work stations and a changeover system as specified above are also a subject of the instant invention. Also, a corresponding changeover process is a further subject of the instant invention.

BRIEF DESCRIPTION OF THE DRAWINGS

Further embodiments of the invention and the advantages resulting therefrom will become apparent from the following description of an embodiment of the invention with the aid of the drawings, in which.

DETAILED DESCRIPTION

Figure 1:
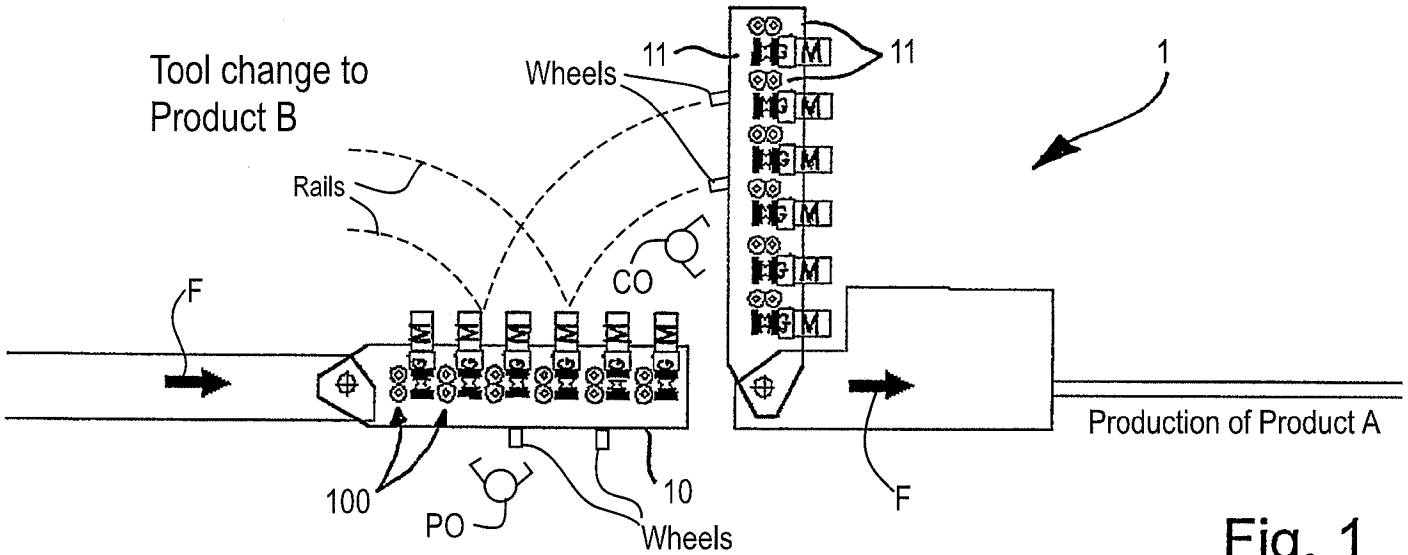
FIG. 1 is a top view of an embodiment of the changeover system according to the instant invention in a state prior to a changeover.

FIG. 1 shows a top view of an embodiment of the changeover system 1 according to the invention. As already mentioned above, changeover system 1 is suitable for being used in a metal forming mill, in particular in a tube-forming mill. The flow of the material to be formed, e.g. the metal strip, is indicated by arrows F.

As can be seen in FIG. 1, changeover system 1 comprises at least one pair of work modules, each pair of work modules comprising two work modules 10 and 11. The two work modules 10,11 (e.g. forming passes, stands) are adapted to be pivoted into an out of a line of work stations of the mill, as will be explained below. For example, work modules 10,11 are pivotally attached at opposite ends to the line of work stations. Work module 10 is positioned in the line of work stations of the mill while at the same time work module 11 is positioned off the line. Two operators, a production operator PO as well as a changeover operator CO, are schematically represented in FIG. 1.

According to FIG. 1 production of a first product A is running. Changeover operator CO prepares work module 11 for a changeover in order to enable the line to produce product B. Preparation of work module 11 can be performed by changeover operator CO while production of product A continues to run. Changeover operator performs preparation of work module 11 on the side opposite to the side where production operator PO is positioned. Accordingly, preparation of work module 11 does not disturb the process of production of product A.

Since—by way of example—the embodiment of changeover system 1 is a system that can be used in a tube-forming mill, work modules 10,11 comprise rollers 100,110 for forming the metal strip material. Also, each work module 10,11 comprises its own drive or drives which may comprise motors M and gears G for driving the rollers 100,110.

Let us now assume, that work module 11 has been prepared and is ready for changeover. For a changeover from production of product A to production of product B the production process in the line of work stations is stopped. In a first step work module 10 is pivoted out of the line of work stations, as this is indicated by arrow P1 in FIG. 2. This pivotal movement happens preferably in a fully automated and synchronized way but could also be performed manually by an operator. Then, in a second step work module 11 is pivoted into the line of work stations, as this is indicated by arrow P2 in FIG. 2. Again, this pivotal movement happens preferably in a fully automated and synchronized way but could also be performed manually by an operator. The line of work stations (the production line) is then ready for production of product B.

In order to simplify the pivotal movement of work modules 10 and 11, rails (not shown) may be provided in the floor in the area of changeover system 1, and work modules 10,11 may be provided with wheels engaging these rails.

Figure 2:
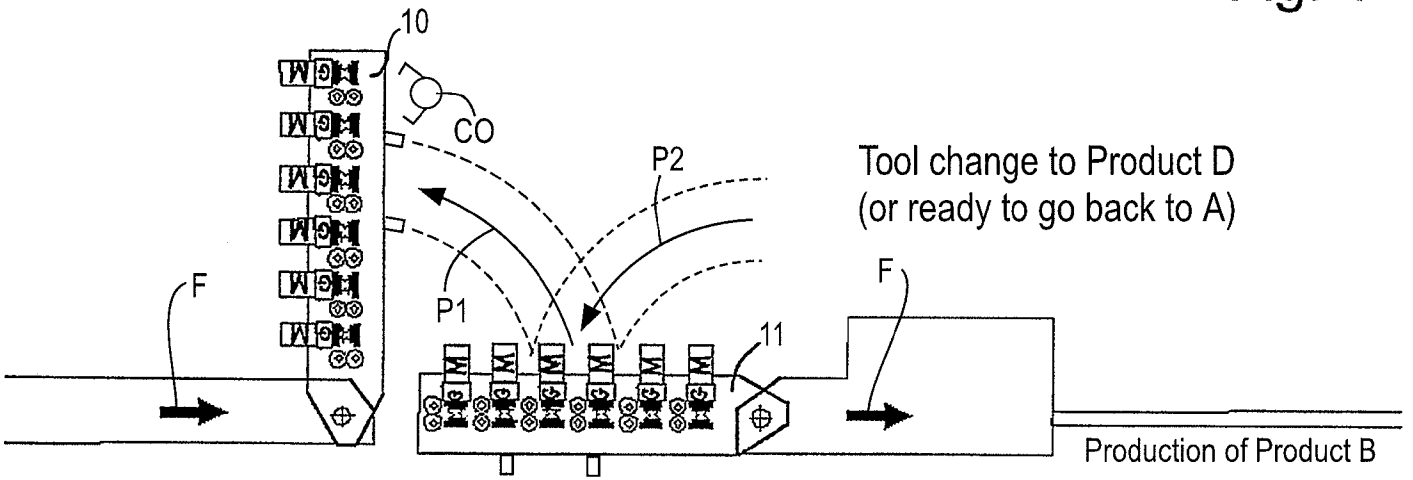
FIG. 2 is a top view of the embodiment of FIG. 1 after the changeover.

In the state shown in FIG. 2 production of product B is running. Production operator PO may control production of product B while changeover operator CO may start mounting to work module 10 a tooling suitable for production of a product C in order to prepare work module 10 for the production of product C (by pivoting work module 10 into the line of work stations after having pivoted work module 11 out of the line of work stations). Alternatively, changeover operator CO may check the tooling mounted to work module 10 and may perform maintenance operations, if necessary, in order to prepare work module 10 for production of product A again (by pivoting work module 10 into the line of work stations after having pivoted work module 11 out of the line of work stations).

While the embodiment described above only comprises one pair of work modules, the invention is to be understood to comprise also changeover systems comprising more than one pair of work modules, i.e. at least two pairs of work modules. In this case, the system can be adapted to change over the work modules of the pairs of work modules at the same time and in a fully automated and synchronized way, whereas in conventional systems the modules can be changed over only one after another. Accordingly, the involvement of the production operator in the changeover process is limited to initiating the automated changeover process—e.g. by pushing a knob. While the changeover process is running fully automated, the production operator is free to do other jobs along the production line during changeover.

Specific embodiments of a Changeover System and Changeover Method for a Metal Forming Mill according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

The invention claimed is:

1. A changeover system that is adapted to be used in a processing line of a metal forming mill, the changeover system comprising:

first and second work modules that are adapted to be operatively mounted in the processing line of the metal forming mill:

each one of the first and second work modules having its own drive or drives, the drive or drives of the first work module being separate from the drive or drives of the second work module;

the first and second work modules being adapted to be independently pivoted with respect to each other about first and second axes, respectively, between an in the line position and an off the line position in a manner such, that only one of the first and second work modules can be arranged in the line at one time while the other of the first and second work modules is arranged off the line;

wherein the first and second work modules can be pivoted about the first and second axes from the off the line position to the in the line position without the need of electrical and mechanical disconnection and reconnection of the one or more drive or drives from the respective work module.

2. The changeover system of claim 1, wherein the first and second work modules are provided with first and second wheels, respectively, in order to simplify the pivotal movement of the work modules between the off the line and in the line positions.

3. The changeover system of claim 2, wherein the metal forming mill includes a floor, and the first and second wheels are adapted to engage the floor of the metal forming mill.

4. The changeover system of claim 2, further comprising first and second rails that are adapted to be arranged in the processing line of the metal forming mill in the area where the first and second work modules are arranged, wherein the first and second wheels of the work modules engage the first and second rails, respectively, to enable a guided pivotal movement of the first and second work modules between the in the line and the off the line positions.

5. The changeover system of claim 4, wherein the metal forming mill includes a floor, and the first and second rails are adapted to be mounted on the floor of the metal forming mill.

6. The changeover system of claim 1, wherein the first and second work modules comprise rollers for forming a tube or an open profile.

7. The changeover system according to claim 1, further comprising third and fourth work modules and third and fourth drive or drives that have the same construction and operate in the same manner as the as the first and second work modules and the first and second drive or drives so that the first and third work modules can be pivoted from in the line positions to off the line positions and, thereafter, the second and fourth work stations can be pivoted from off the line positions to in the line positions.

8. The changeover system of claim 1, wherein the first work module is adapted to form a first metal product, and wherein the second work module is adapted to form a second metal product.

9. The changeover system of claim 8, wherein the first metal product comprises a tube.

10. The changeover system of claim 8, wherein the second metal product comprises a tube.

11. A method of using the changeover system of claim 1 in the metal forming mill of claim 1 to allow a changeover from forming a first metal product to forming a second metal product, the method comprising the steps of:

operatively mounting first and second work modules in the processing line of the metal forming mill, the first work module being disposed in an in the line position with respect to the processing line of the metal forming mill and the second work module being disposed in an off the line position with respect to the processing line of the metal forming mill;

operatively mounting first and second drive or drives with respect to the first and second work modules;

pivoting the first work module about the first axis from the in the line position to the off the line position;

pivoting the second work module about the second axis from the off the line position to the in the line position; and using the second work module to form a second metal product.

12. A combination comprising the changeover system and metal forming mill of claim 1.

13. The combination of claim 12, wherein the metal forming mill comprises a tube-forming mill.

* * * * *